United States Patent [19]

Boutcher, Jr. et al.

[11] 4,275,495

[45] Jun. 30, 1981

[54] CONNECTOR TERMINATING TOOL

[75] Inventors: Andrew G. Boutcher, Jr.; Walter C. Shatto, Jr., both of Harrisburg, Pa.

[73] Assignee: AMP Incorporated, Harrisburg, Pa.

[21] Appl. No.: 53,673

[22] Filed: Jul. 2, 1979

[51] Int. Cl.[3] ..... H01R 43/04

[52] U.S. Cl. ..... 29/749; 29/753; 29/861

[58] Field of Search ..... 29/749, 751, 753, 759, 29/566.3, 566.4, 861

[56] References Cited

U.S. PATENT DOCUMENTS

| | | | |
|---|---|---|---|
| 4,006,519 | 2/1977 | Long et al. | 29/749 |
| 4,175,320 | 11/1979 | Nijman | 29/749 |

*Primary Examiner*—Carl E. Hall

*Attorney, Agent, or Firm*—Anthony S. Volpe

[57] ABSTRACT

An apparatus for simultaneous location and termination of a plurality of stripped conductors in a connector is disclosed. The apparatus comprises a body having a connector orienting cavity, a conductor comb for aligning the stripped conductor, a conductor wiper assembly disposed parallel to said cavity and conductor insertion tooling disposed perpendicular to said cavity.

6 Claims, 26 Drawing Figures

180
2
4
186
182
176
170
40
175
178
56
50
174
184
190
90
91
94
172
90a
10
92
160
160
145
148
16
12
50
40
140
16
126
146
200
18
130
17
142
60
30
134

Fig. 3
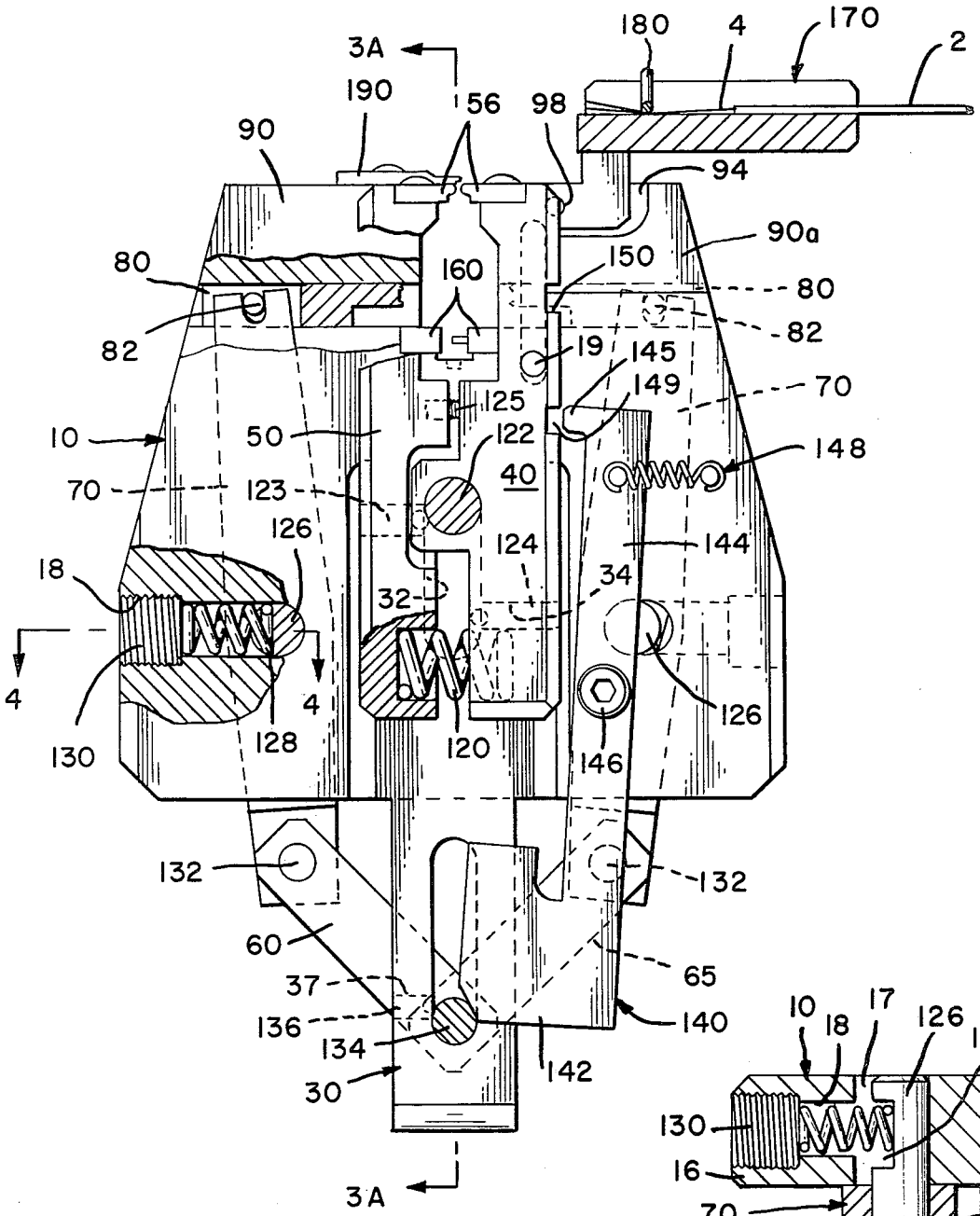
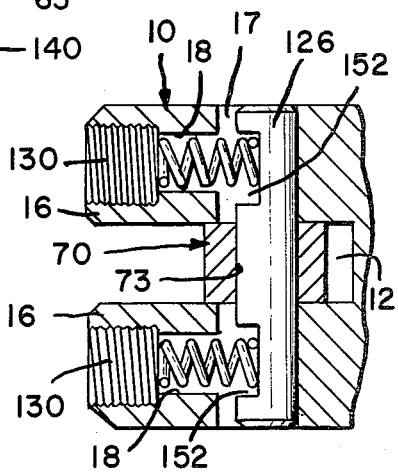
Fig. 4

Fig. 5
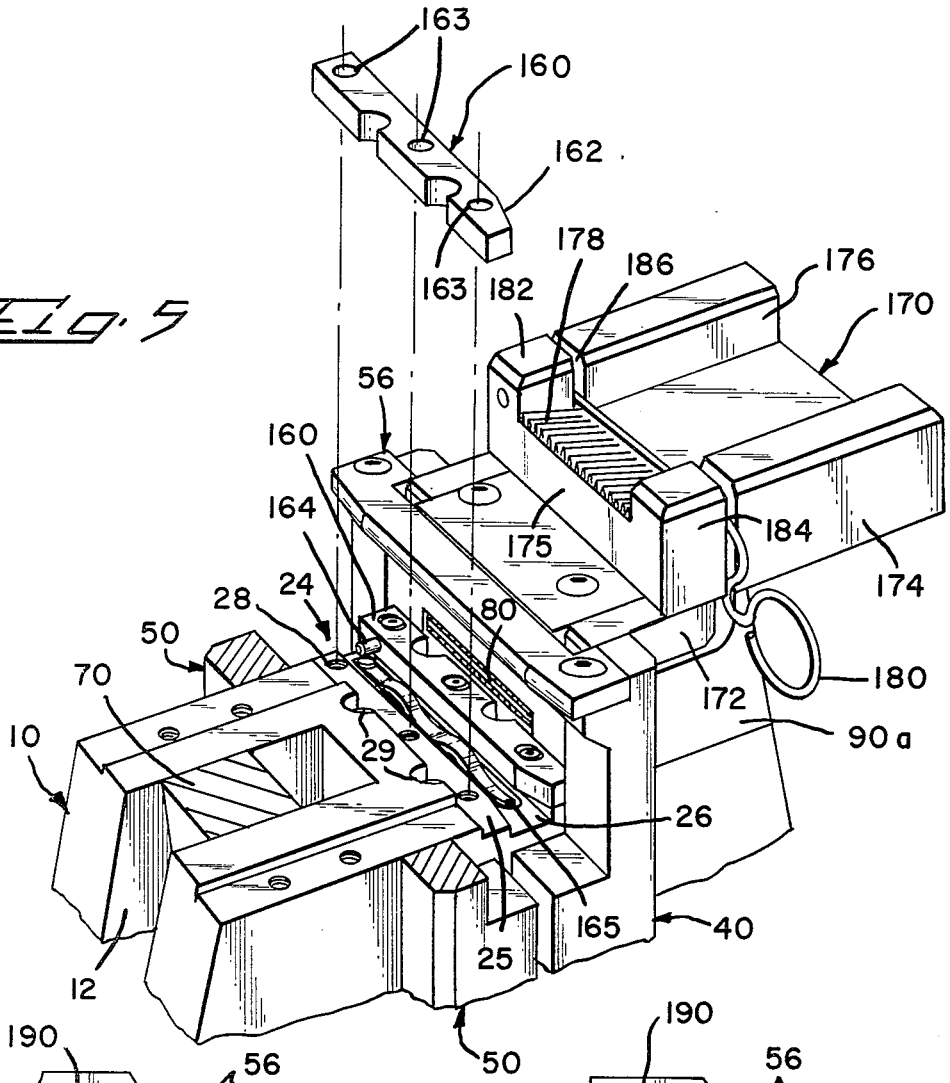
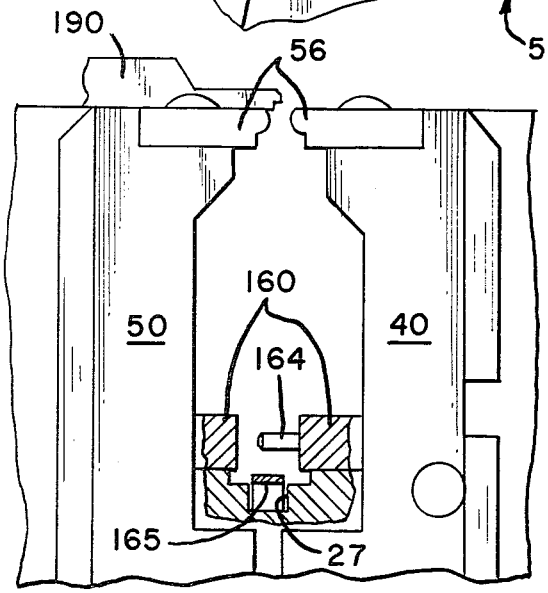
Fig. 6
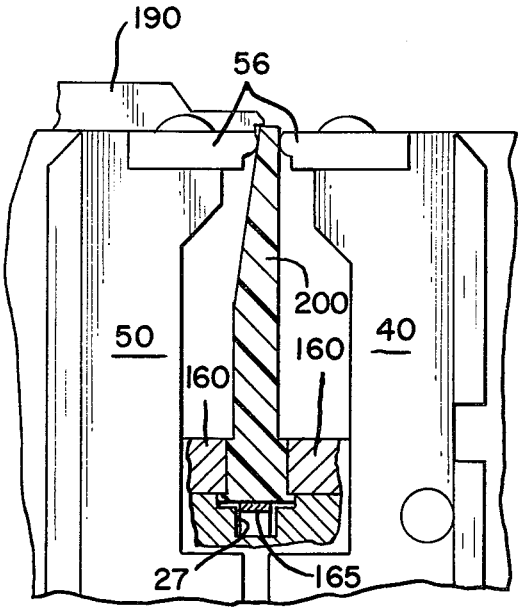
Fig. 6A

Fig. 7
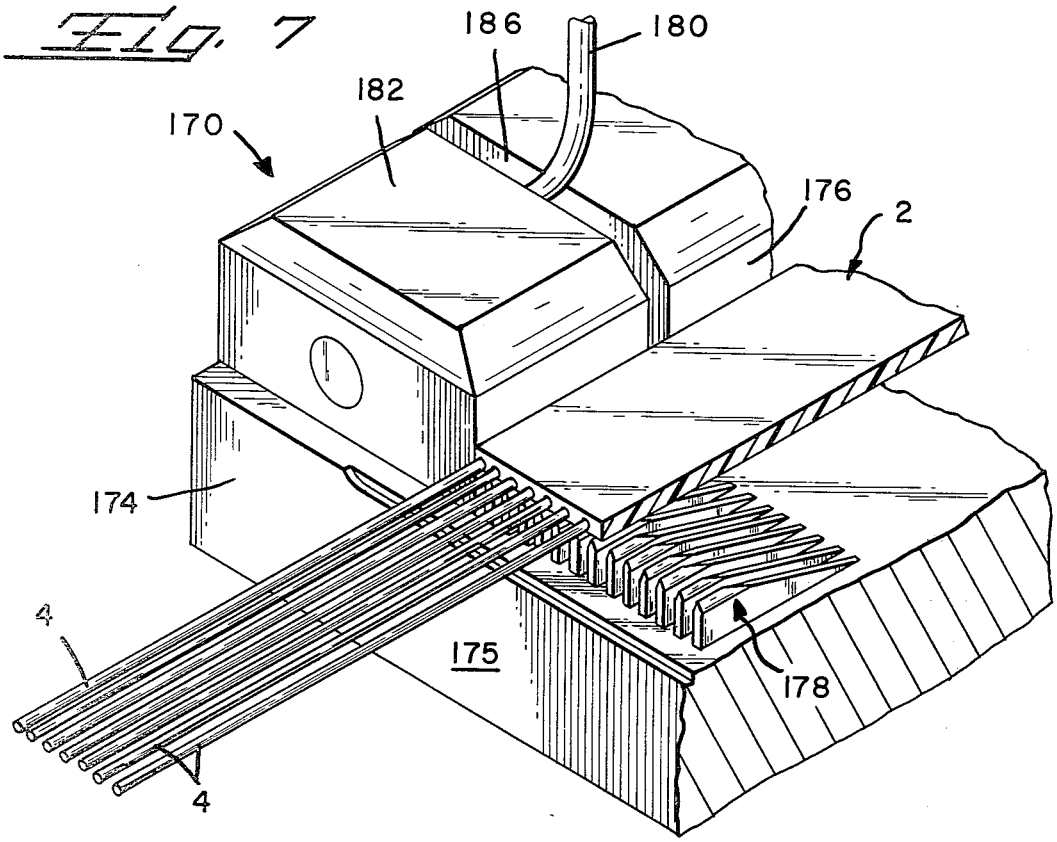
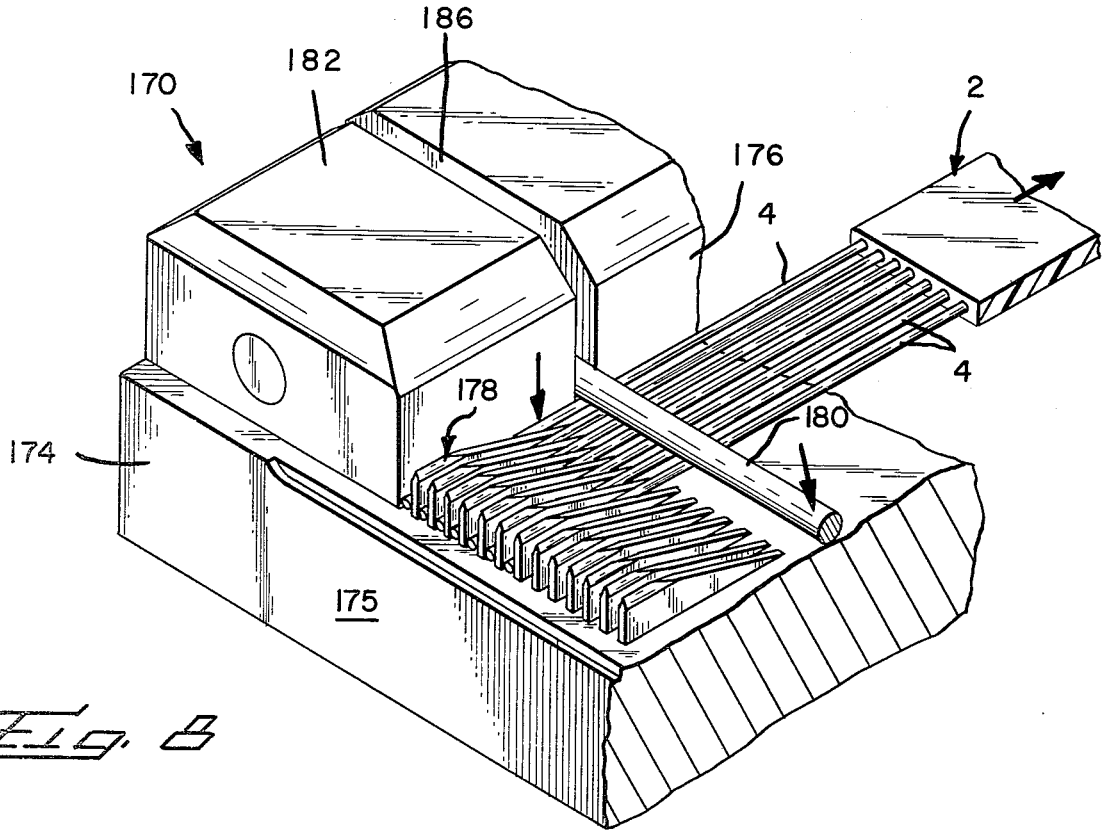
Fig. 8

Fig. 9
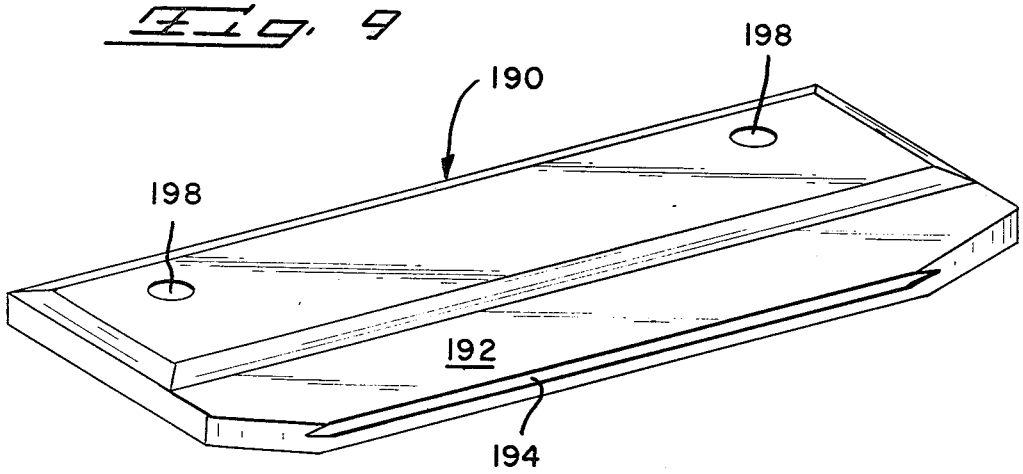
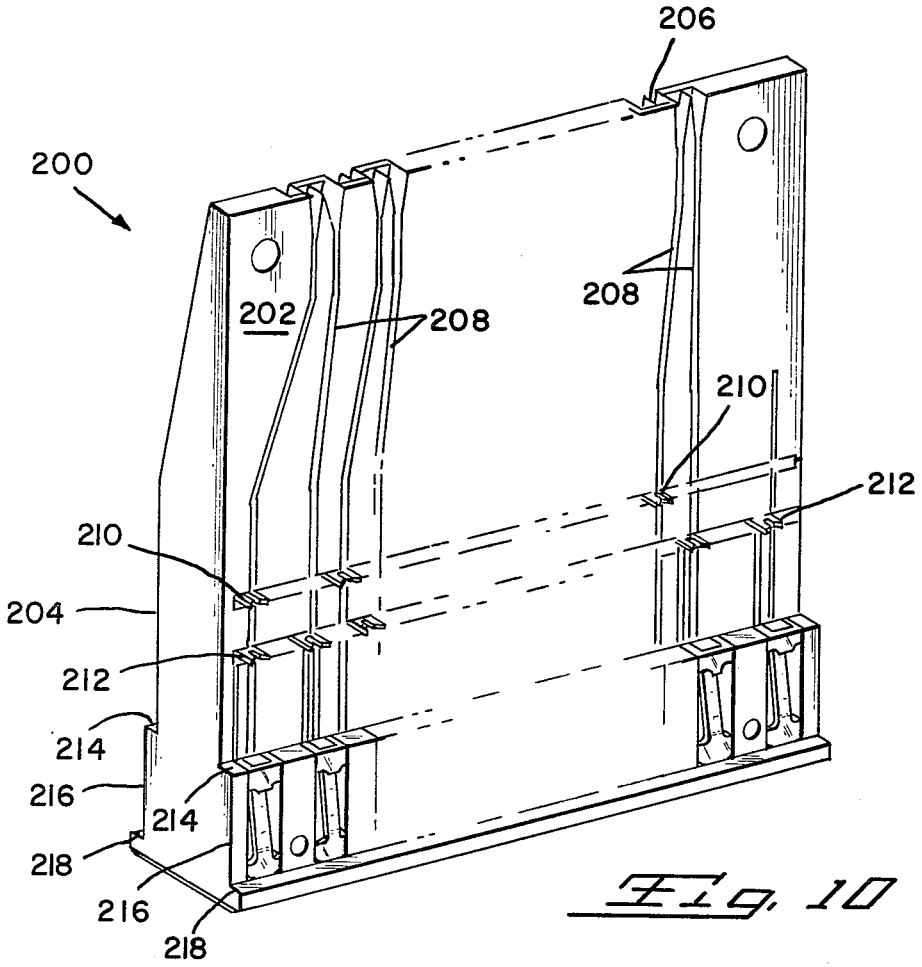
Fig. 10

CONNECTOR TERMINATING TOOL

BACKGROUND OF THE INVENTION

1. The Field Of The Invention

This invention resides in the broad field of electrical connector termination apparatus. The disclosed embodiment resides in the general class of fine conductor termination apparatus and is particularly suited for use in terminating multi-conductor ribbon cable such as is used in the communication and computer industries.

2. The Prior Art

There are a number of prior art devices intended for terminating multi-conductor cables of either the discrete wire or ribbon conductor type. There are generally three different classes of devices. The first class, generally used with discrete wire, includes devices which require location of the conductors in a lacing comb or in a pretermination position on the connector. The second class includes those devices which incorporate a wire deploying template to locate the conductor prior to insertion in the connector. The third class includes vice or press like devices which clamp a connector about the conductors embedded in the insulation of a ribbon cable.

The problem with the prior art devices are that they are generally large cumbersome devices unsuited for use with fine conductors and not very flexible in application. The present invention seeks to overcome these prior art problems with a compact, very flexible tool which may be manually or automatically operated.

SUMMARY OF THE INVENTION

The present invention comprises a compact manual or automatic apparatus for rapid insertion of a plurality of fine conductors in a connector having a modified termination centerline from that of the plural conductors. The apparatus has an adjustable connector cavity to locate the connector in a precise orientation within the cavity. A conductor wiper system is deployed parallel to the connector cavity for wiping the connectors into a predetermined configuration. An insertion tool system is operated perpendicularly to the connector cavity to terminate the conductor in a solderless termination. The preferred embodiment includes a conductor comb to achieve control of the conductor prior to presentation to the connector.

It is an object of this invention to provide a compact apparatus which may be operated with equal efficiency in a plant or field environment.

It is an object of this invention to provide an apparatus which may be manually or automatically operated.

It is an object of this invention to provide an apparatus which may be operated by a technician with little or no special training.

It is an object of this invention to provide an apparatus which will operate on both sides of a connector in a single operation.

The foregoing objects and other advantages will become apparent to those skilled in the art from the following detailed description taken with reference to the accompanying drawings.

BRIEF DESCRIPTION OF THE DRAWINGS

FIG. 3 is a side elevation of the tool with parts broken away to highlight features.

FIG. 4 is a fragmentary section through the line 4—4 of FIG. 3.

FIG. 5 is a fragmentary perspective of the connector cavity with portions broken away to show the interior of the cavity.

FIG. 6 is a fragmentary view of the complete connector cavity showing the alignment means.

FIG. 6A is a fragmentary view showing the connector in place.

FIG. 7 is an enlarged fragmentary perspective of the conductor comb.

FIG. 8 is an enlarged fragmentary of the conductor comb showing the conductors in place.

FIG. 9 is a perspective of the guide plate.

FIG. 10 is a perspective of the connector used with the preferred embodiment.

DESCRIPTION OF THE PREFERRED EMBODIMENT

Figure 1:
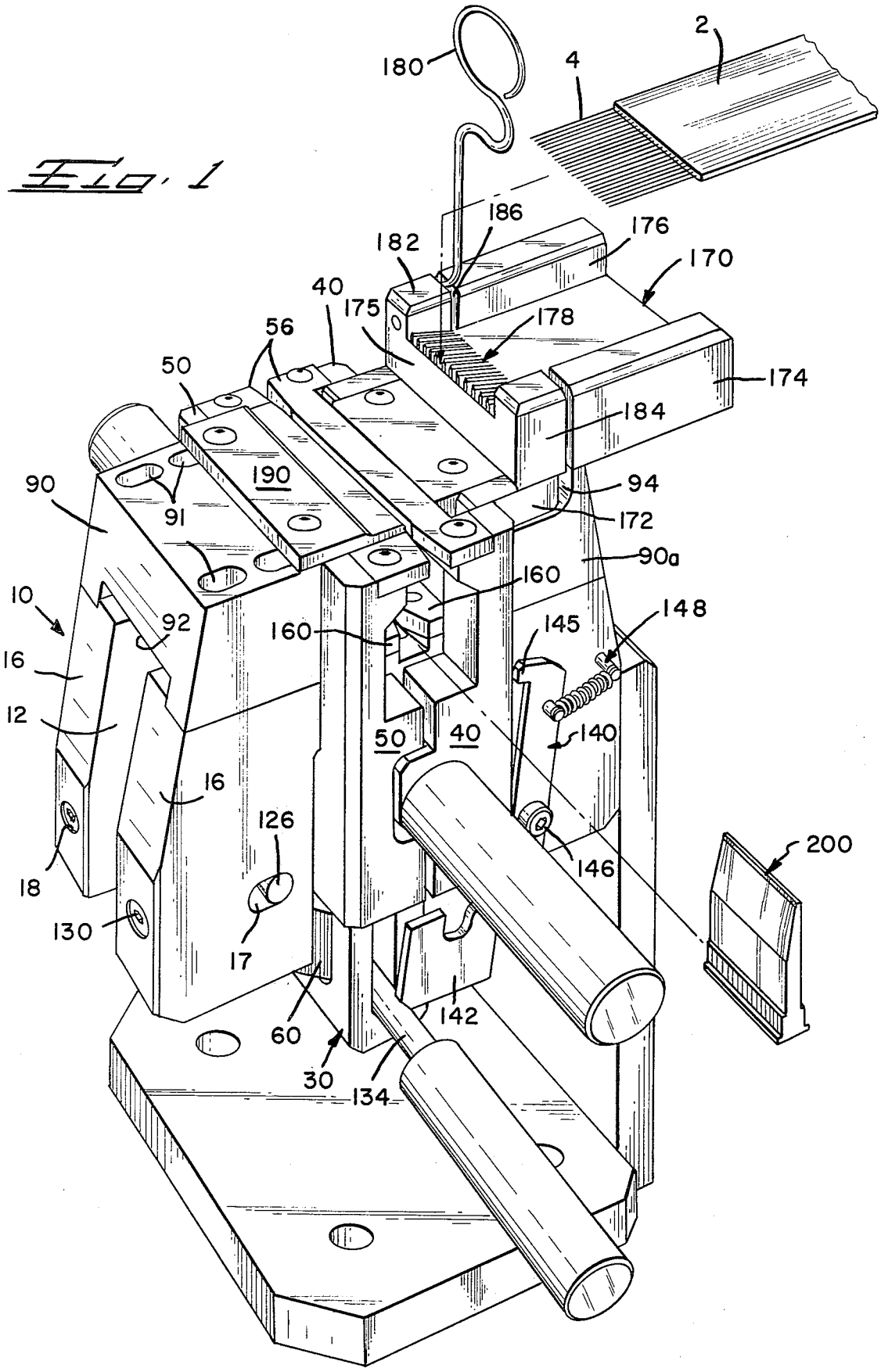
FIG. 1 is a perspective view of the tool with the connector and cable exploded out.

FIG. 1 shows a manually operated bench mounted apparatus according to the instant invention. It should be noted that the same apparatus may be automated or modified for mounting in a field environment.

Figure 2:
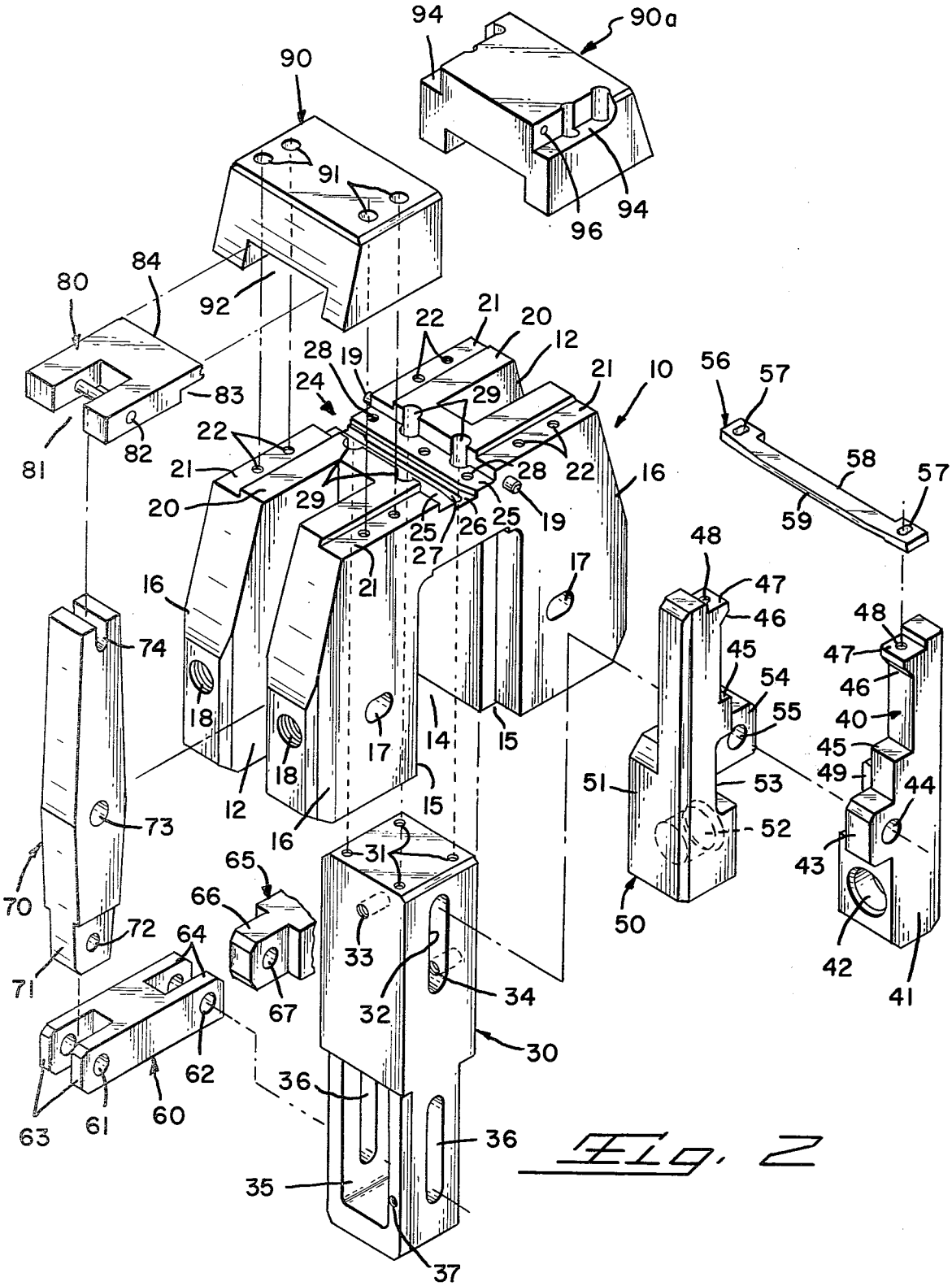
FIG. 2 is an exploded view of the tool shown in FIG. 1 highlighting the major components of the tool.

FIG. 2 is an exploded view of the tool in FIG. 1 showing each of the major components of the tool. In the complete tool items 40, 50, 56, 70, 80 and 90 are used in duplicate.

Housing 10 has two opposed cavities 12 which, from a top view, give it a generally H shape. Cavity 14 is perpendicular to and intersects the vertical plane of cavities 12. Recess 15 is immediately adjacent and outside of cavity 14. Each block 16 of the housing 10 has an oval passage 17 which communicates with cavity 12 and a bore 18 which is perpendicular to and communicates with oval passage 17. As can be seen, opposed blocks 16 have passages 17 on centerline. Bore 18 is threaded part way to accept a set screw. In addition, two of the blocks 16 have a guide pin 19 which are received in complementary slots in wiper arm 40.

The upper portion of housing 10 has surfaces 20 which are on either side of recess 24 and lie in a common plane. Surfaces 21 lie in a common plane which is parallel to and below the plane of surfaces 20. Bolt holes 22 are drilled and tapped along surfaces 21. Recess 24 is perpendicular to the plane of surfaces 20 and has two ridges 25 which define a second parallel recess 26. A slot 27 is cut into recess 26. A plurality of bolt holes 28 are drilled and tapped along ridge 25. Four passageways 29 are drilled from surfaces 20 through to cavity 14.

Guide block 30 is dimensioned to be received in cavity 14 and has four bolt holes 31 drilled and tapped on centerlines with passageways 29. The upper half of guide block 30 has an elongated passage 32 therethrough. Bore 33 is perpendicular to elongated passage 32 and communicates with the upper end thereof while similar bore 34 communicates with the lower end thereof. The lower half of guide block 30 has a large hollow 35 which extends perpendicularly to the plane of passage 32. Slots 36 on either side of hollow 35 lie in the same plane as passage 32 and likewise are perpendicular to hollow 35. A hole 37 is drilled perpendicular to and in communication with one slot 36. Thus, it can be seen that guide block 30 is positioned in cavity 14 and fastened to housing 10 by securing bolts or other suitable fasteners through passageways 29. Alternatively, housing 10 and guide block 30 may be cast as a single unit.

Wiper arms 40 and 50 have essentially the same features and are designed to achieve a complimentary fit. Arm 40 has a main body portion 41 which has been drilled at the base portion to provide spring seat 42. Flange 43 extends from body portion 41 and has a bore 44 through the flange. Body portion 41 has step back 45 to provide clearance through to cavity 24 of housing 10 and is angled outward at 46 to provide plateau 47 at the upper end thereof. Plateau 47 has been drilled and tapped to provide bolt holes 48. Arm 50 has a main body portion 51, which has been drilled at the base to provide spring seat 52 which compliments spring seat 42. Recess 53 is dimensioned to provide clearance for flange 43 of arm 41. Flange 54 extends from main body portion 51 and is accepted in complimentary recess 49 of arm 40. Bore 55 in flange 54 is equal to and on centers with bore 44 of arm 40. The remainder of body portion 51 beginning at the step back 45 is the mirror image of arm 41. Wiper 56 is sufficiently long to span housing 10 and to be attached to the respective wiper arms located on either side of housing 10. Oval passages 57 are drilled through wiper 56 on centerline with bolt holes 48. A clearance notch 58 is provided to assure the free passage of wiper 56 by cap 90. A machined wiping surface 59 is provided to prevent conductor damage.

Bar link 60 is H shaped and has holes 61 and 62 on respective centerlines drilled through the leg members 63 and 64. Bar link 65 has a flange 66 which is dimensioned to fit between the leg members 64 and a hole 67 drilled on centerline with holes 62. The other end of bar link 65 is a half H identical to that of bar link 60.

Rocker arm 70 is dimensioned to be received in cavity 12. Flange 71 of rocker arm 70 is dimensioned to be received between leg members 63. Hole 72 in flange 71 is on centerline with holes 61. Hole 73 of rocker arm 70 is located on center with oval passage 17 in housing 10. Groove 74 is cut through the upper portion of rocker arm 70.

Tool carrier 80 has a relief 81 cut in one end thereof. The carrier is drilled on either side of relief 81 to permit the insertion of dowel pin 82 which is dimensioned and located to be received in groove 74 of rocker arm 70. Tool carrier 80 is notched at 83 to provide clearance during tool insertion. Face 84 of tool carrier 80 is designed to meet connector specifications and will be discussed hereinafter.

Cap 90 has passageways 91 which are on centerlines with bolt holes 22 for securing cap 90 to housing 10. Passage 92 is cut through cap 90 and is dimensioned to receive tool carrier 80 and act as a guide for tool carrier 80.

Cap **90*a* is substantially identical to cap 90 and has additional recesses 94 and dowel pin hole 96. Recesses 94 and dowel pin hole 96 are modification which permit the attachment of a combing device which will be explained hereinafter. However, it should be understood that the modified cap and comb are preferred for the specific application and that two identical caps 90** would provide a tool with all the advantages of the instant invention.

Assembly

Figure 3B:
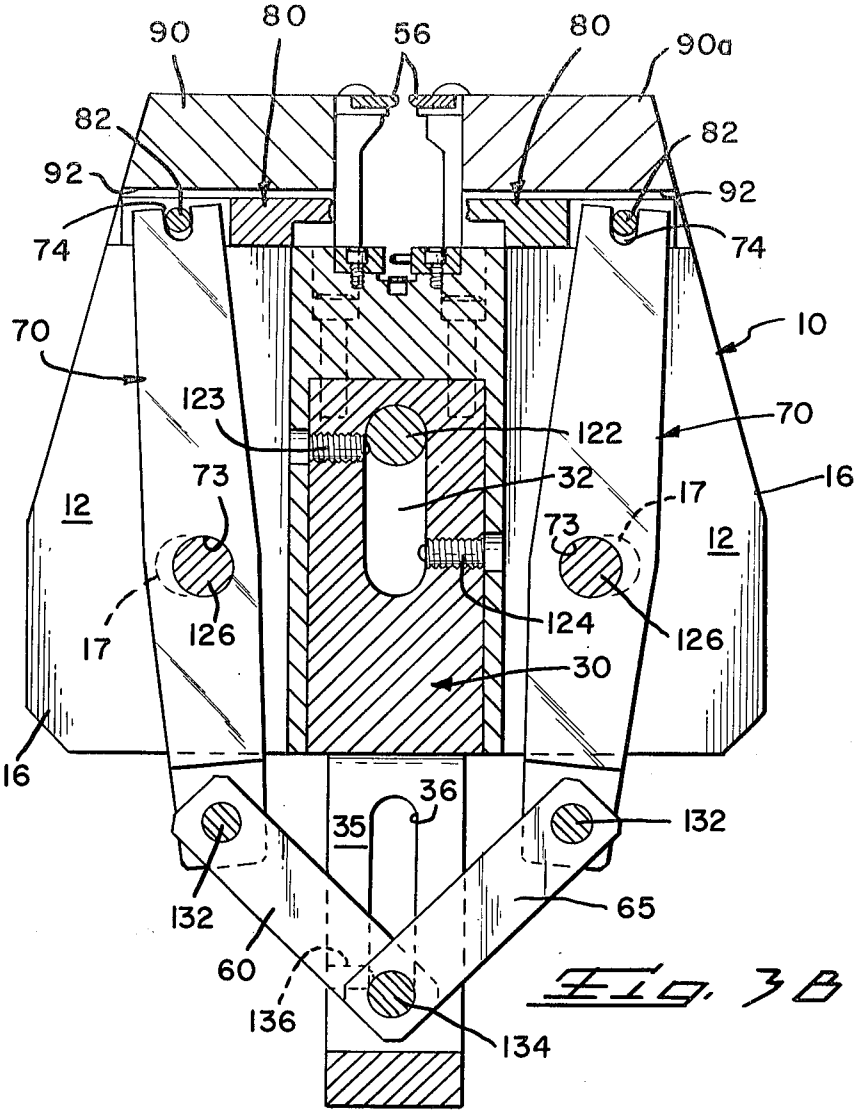
FIG. 3B is a cross-section taken along the line 3B—3B of FIG. 3A.
Figure 3A:
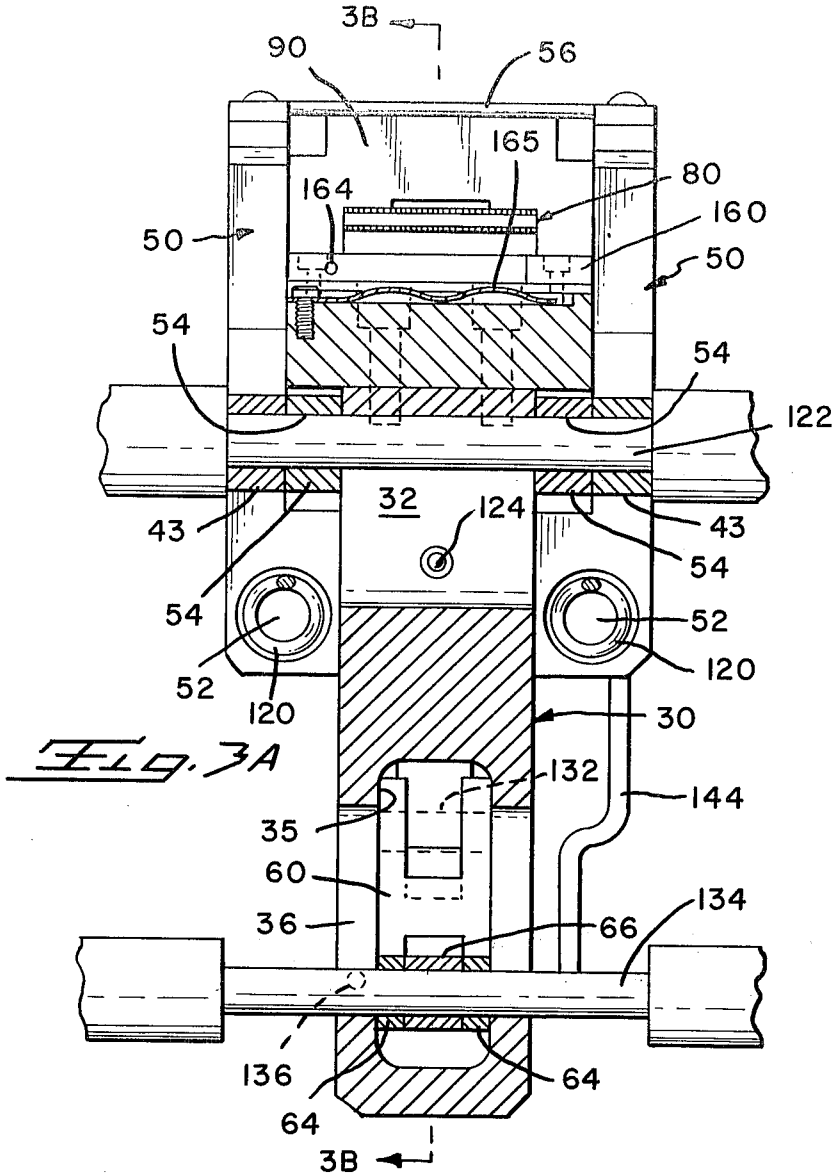
FIG. 3A is a cross-section taken along the line 3A—3A of FIG. 3.

The assembly of preferred embodiment may be clearly seen by reference to FIGS. 3, 3A and 3B. FIG. 3 shows the entire assembly with features highlighted to convey the compactness of the apparatus. FIGS. 3A and 3B are sectional views which highlight the locating, wiping, and inserting features of the apparatus.

Guide block 30 is secured to housing 10 with suitable fasteners. Wiper arms 40 and 50 are assembled with spring 120 located between spring seats 42 and 52. Remembering that two identical arms are on the opposite side of housing, a common shaft 122 is located through holes 44 and 54 of the wiper arms and elongated passage 32 of guide block 30. The wiper arms 40 are located over pins 19 on housing 10. The slot in arms 40 is of sufficient length to permit full travel of shaft 122 within elongated passage 32. Ball dents 123 and 124 are located in holes 33 and 34 respectively as positive stops for shaft 122. At this point it should be noted that as shaft 122 is moved downward, pin 19 will restrict arm 40 to vertical movement only while arm 41 is free to pivot somewhat about shaft 122. An initial spread between arms 40 and 50 may be achieved by a set screw as illustrated at 125. Note also that at this point wipers 56 are assembled to wiper arms 40 and 50.

Rocker arms 70 are located in the respective cavities 12 with groove 74 in the up position and shafts 126 are located in the oval passages 17 and holes 73 of rocker arms 70. Note that shaft 126 has sufficient space in oval passage 17 to permit some horizontal movement. A spring 128 and a set screw 130 are located in partially threaded hole 18. The configuration of shaft 126 and its relationship to spring 128 and set screw 130 will be discussed in more detail hereinafter.

Turning now to tool carrier 80, it is located on surface 20 of housing 10 so that dowel pin 82 drops into groove 74 of rocker arm 70. Carrier 80 will ride on surface 20 of housing 10. The rocker arm 70 is of sufficient length to assure that pin 82 remains in groove 74. Cap 90 is placed over tool carrier 80 and bolted to housing 10. Passage 92 is dimensioned to permit tool carrier 80 to move in and out freely but at the same time restrict vertical or sideway movement. In the preferred assembly modified cap 90a is used with a combing assembly 170 mounted with dowel pin 98 in hole 96 see FIGS. 15 and 16.

Referring to FIGS. 3, 3A and 3B, the two rocker arms 70 are interconnected by means of bar links 60 and 65. Bar links 60 and 65 are connected to their respective rocker arm 70 with shafts 132. Bar links 60 and 65 are then located in hollow 35 of guide block 30 with the flange 66 being between the leg members 64, shaft 134 is then located in slots 36 of guide block 30 and through holes 62 and 67 of the bar links. A ball dent 136 is located in hole 37.

A safety pawl 140 is added to the assembly of the preferred embodiment to prevent damage to tool carrier 80. Pawl 140 has a follower 142 which rides on shaft 134 and a vertical shaft 144 having a finger 145 integral therewith. Shaft 144 is secured to housing 10 by pivotal mount 146 and is biased by spring assembly 148. Receiving notches 149 and 150 have been cut in one wiper arm 40 to receive finger 145. When shaft 122 is in the up position, movement of shaft 134 upward will cam finger 145 into notch 149 and prevent downward movement of shaft 122. When shaft 122 is in the down position, movement of shaft 134 upward will cam finger 145 into notch 150 and prevent upward movement of shaft 122, this relationship is clearly shown in FIGS. 15 and 16.

At this point, further discussion of shaft 126 is useful. Referring now to FIG. 4 which is a section through 4—4 of FIG. 3, there is shown fragmentary view shaft 126 as assembled to rocker arm 70. Note that shaft 126 is movably horizontally within oval passage 17. Shaft 126 is cut to provide spring seats 152. Spring 128 is inserted in hole 18 and pre-loaded via set screw 130. Spring 128 is compressed during movement of rocker arm 70 and then provides the insertion force override for tool carrier 80. This will be discussed more fully in the operational section hereinafter.

The assembly of the apparatus is now complete with respect to the wiping and tool insertion mechanism and we will now turn to the connector location and conductor guidance features shown in FIG. 5. Registration plates 160 for mounting on ridges 25 are dimensioned to maintain a connector located between them in recess 26 in a vertical position. Registration plates 160 may be adjusted for height by locating shims between the plates and ridges 25. A leaf spring 165 is located in slot 27 to bias the connector against plates 160. Registration plates 160 have a lead-in 162 as an aide in inserting a connector, a counter bore 163 is provided to bolt the plates 160 to housing 10 without interfering with the movement of tool 80. Additionally, one registration plate is fitted with a stop pin 164 which serves to center the connector within cavity 24 and in alignment with tool carriers 80. This relationship may be seen more clearly by reference to FIGS. 6 and 6A.

Referring again to FIG. 5, conductor guidance is achieved by comb assembly 170 and guide plate 190. Comb assembly 170 has a hinge arms 172 pivotly mounted on cap 90a and the back side of comb body 174 (comb mounting not shown but see FIGS. 15 and 16 for cap mounting). Comb body 174 has a cable receiving recess 176 which is opened at the rear end thereof and has a conductor comb 178 at the front end thereof. Conductor comb 178 is recessed slightly from front face 175. A conductor latch wire 180 is pivotly pinned to sidewall 182 and extends beyond sidewall 184. Both sidewall 182 and 184 have slots 186 cut to a depth below cable receiving recess 176 to assure cable contact. Conductor comb 178 and latch 180 are shown in enlarged fragmentary views in FIGS. 7 and 8 prior to and after conductor combing.

Guide plate 190 shown in FIG. 9 has a forward ridge 192 which in the preferred embodiment is sloped forward at 194. The forward ridge 192 compliments comb 178 which rests thereon and forward slope 194 provides a lead in from comb 178 to insure conductor capture, see FIG. 13. Referring again to FIG. 5, holes 198 are provided to fasten plate 190 to cap 90. The use of comb assembly 170 and guide plate 190 will be explained more fully in the operational section.

Before detailing the operation of the instant invention it would be useful to examine the connector shown in FIG. 10 for which the preferred embodiment has been tailored. Connector 200 has a vertical surface 202 on one side and combination sloped surface and vertical surface 204 on the other side. Surfaces 202 and 204 have at the upper end thereof conductor directing funnel entries 206 which communicate with a respective conductor groove among the plurality of conductor grooves 208. Each conductor groove 208 has a ground or signal designation and will have appropriate conductor terminating means located in ground termination area 210 or signal termination area 212. The terminal means are slotted terminals for establishing solderless electrical connections. Surfaces 202 and 204 extend downward from the funnel entries 206 to plateaus 214. Vertical surfaces 216 extend from plateaus 214 to base ridges 218.

It will be obvious that features of the instant invention as disclosed in the preferred embodiment have been tailored to accommodate the connector 200 and that the invention may be readily adapted for other connectors. A detailed explanation of the connector 200 is contained in Patent application Ser. No. 28,952.

OPERATION

Figure 11:
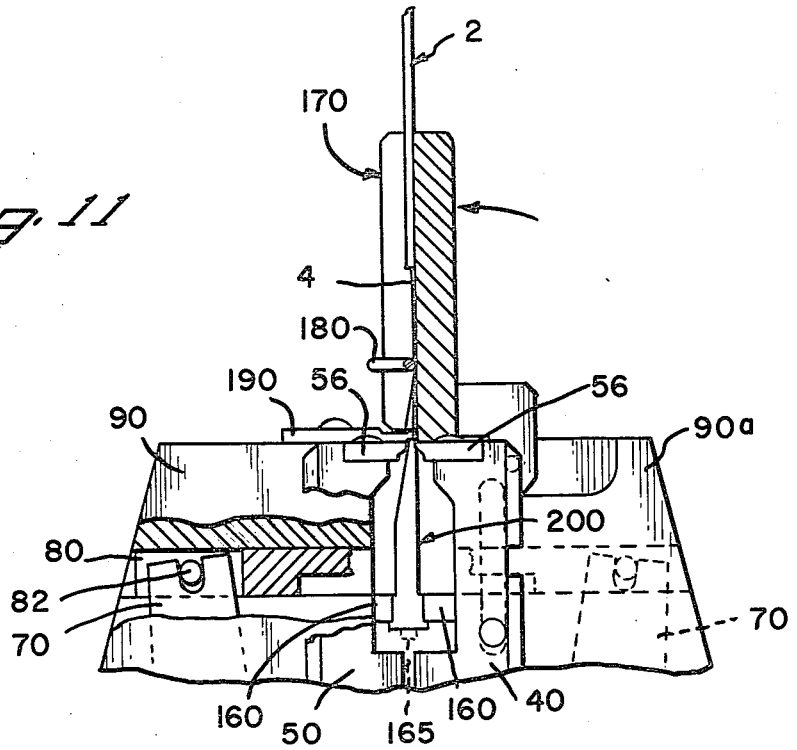
FIG. 11 is a fragmentary of cable address.
Figure 12:
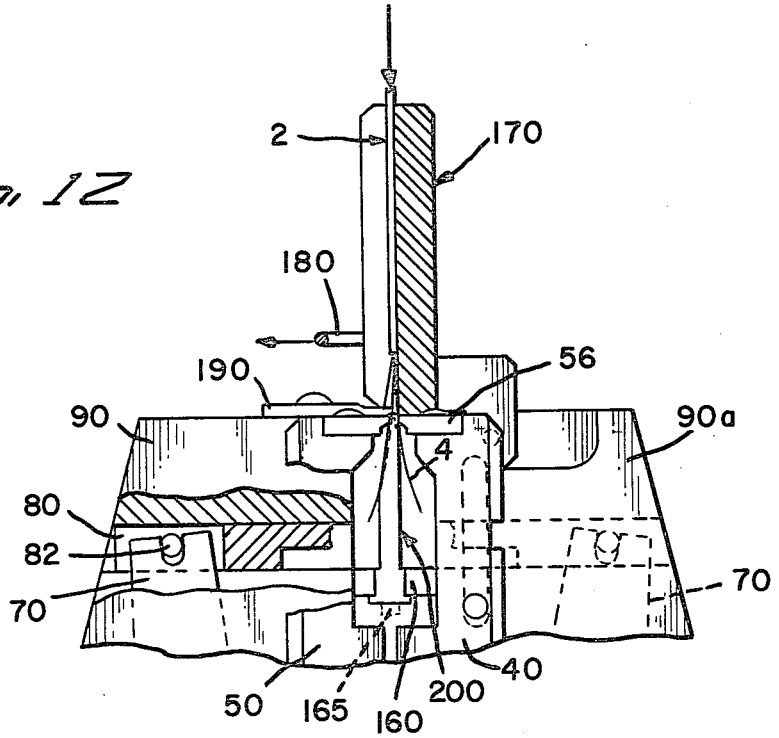
FIG. 12 is a fragmentary of cable insertion.

The operation of the preferred embodiment is depicted in detail in FIGS. 11 through 20. As shown in FIG. 11, the connector 200 is inserted into recess 24. Registration plates 160 are adjusted to contact on base ridges 218 of the connector which is bottomed on recess 26. Leaf spring 165 is used to bias the connector against plates 160 and to compensate for possible production tolerance in the connector 200. However if the connector is manufactured to tolerances, it has been found that satisfactory results are still achieved without the use of leaf spring 165. The connector is inserted fully until contacting stop pin 164. A ribbon cable 2 with the conductor insulation stripped is located in recess 176 with the conductors 4 forward of the comb 178. The cable is drawn down and rearward and the conductors enter comb 178. After the conductors have been fully located, latch 180 is secured to retain conductor positioning. This has previously been shown in FIGS. 7 and 8. Comb assembly 170 is then moved upward, the latch 180 is released and the conductors are moved downward, this sequence is shown in FIGS. 11 and 12.

Figure 13:
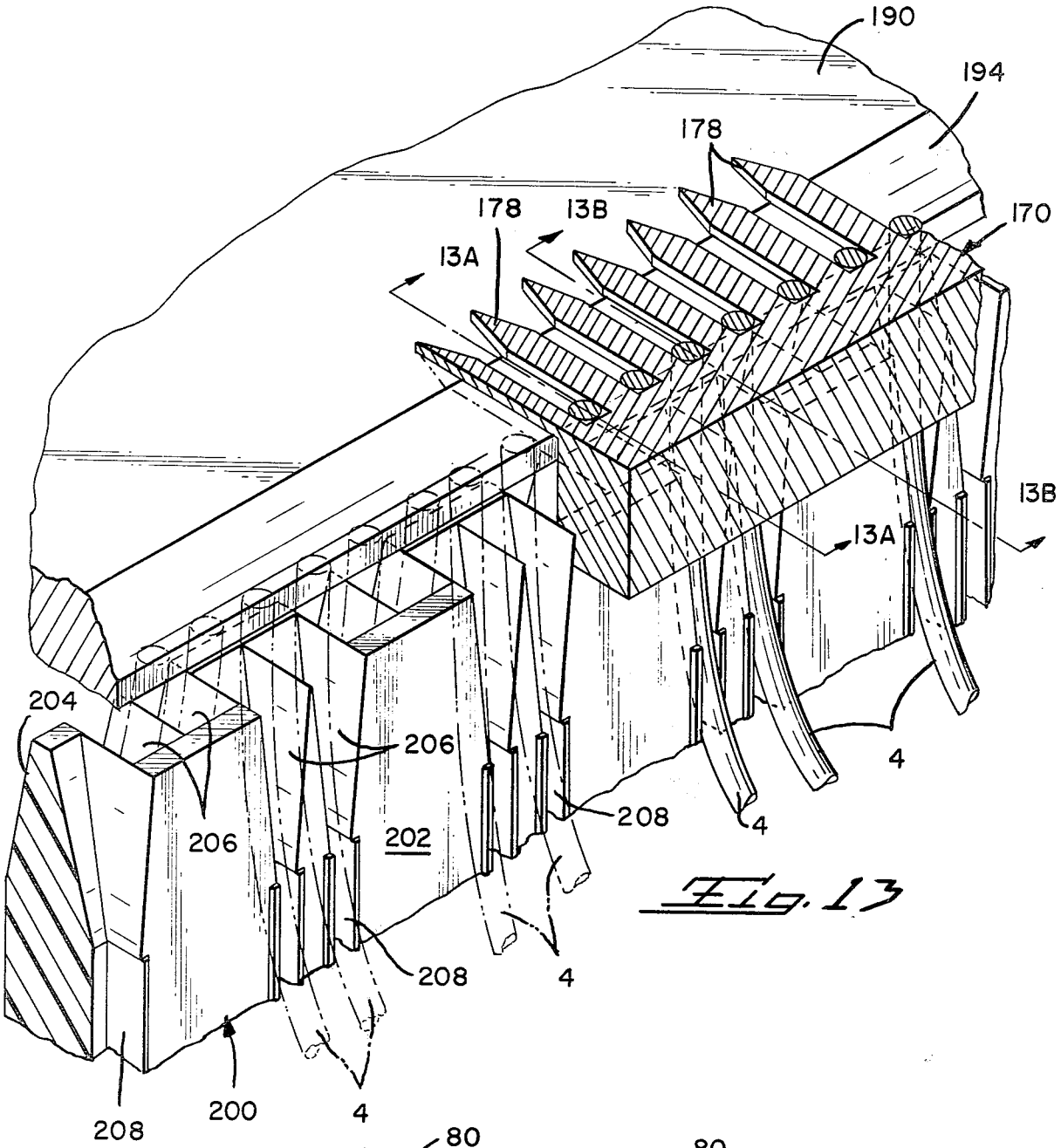
FIG. 13 is a fragmentary perspective showing the cooperation of connector, guide feature, and conductors at the entry position.
Figure 13A:
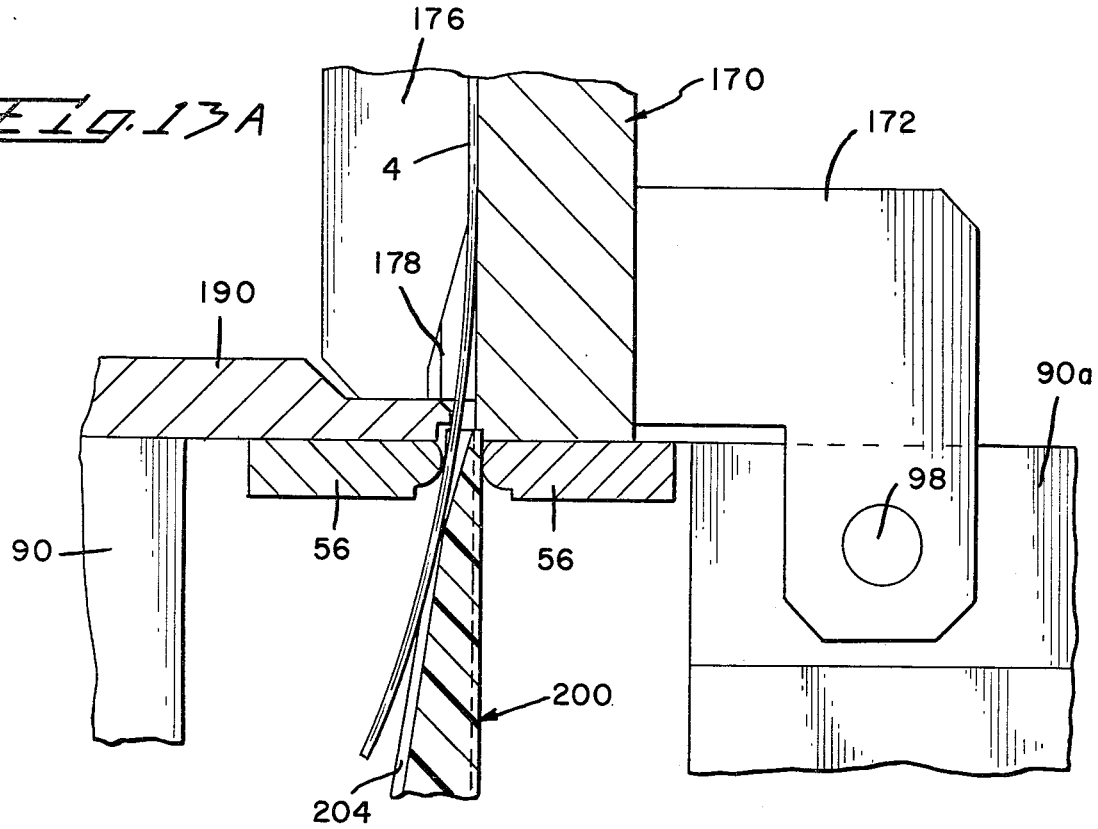
FIG. 13A and 13B are fragmentary taken from FIG. 13 showing the conductor position on either side of the connector.
Figure 13B:
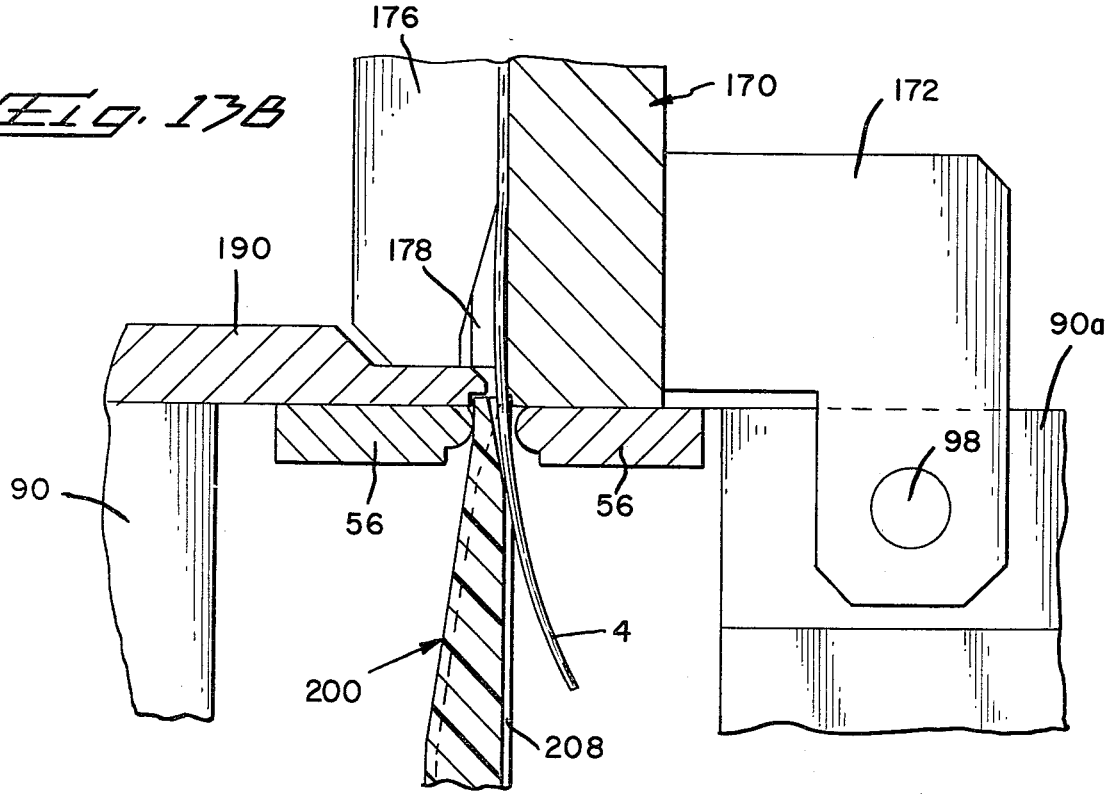

FIG. 13 is an enlarged fragmentary perspective of the top portion of connector and its relationship to the comb assembly 170 and the guide bar 190 during conductor movement. Notice that the guide bar 190 and the comb assembly 170 are positioned slightly over the connector. This is a location means to assure that the conductors are pesented over the centerline of the connector. Once the conductors 4 are properly presented over the centerline of the connector 200, the connector will determine the conductor path, this is shown in FIGS. 13A and 13B for a single conductor 4 on either side of connector 200.

Figure 14:
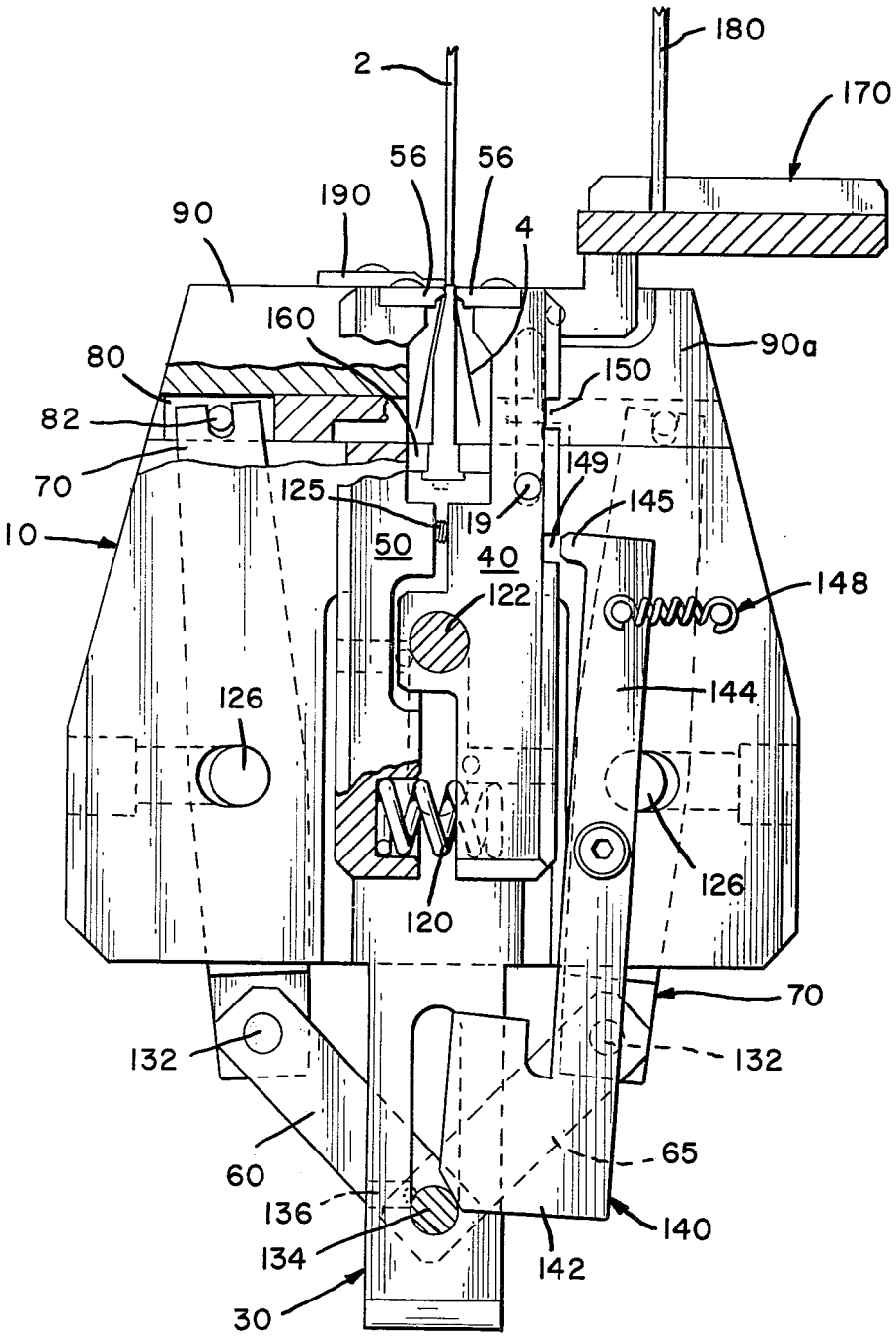
FIG. 14 is a side elevation with parts broken away showing the position after insertion.
Figure 16:
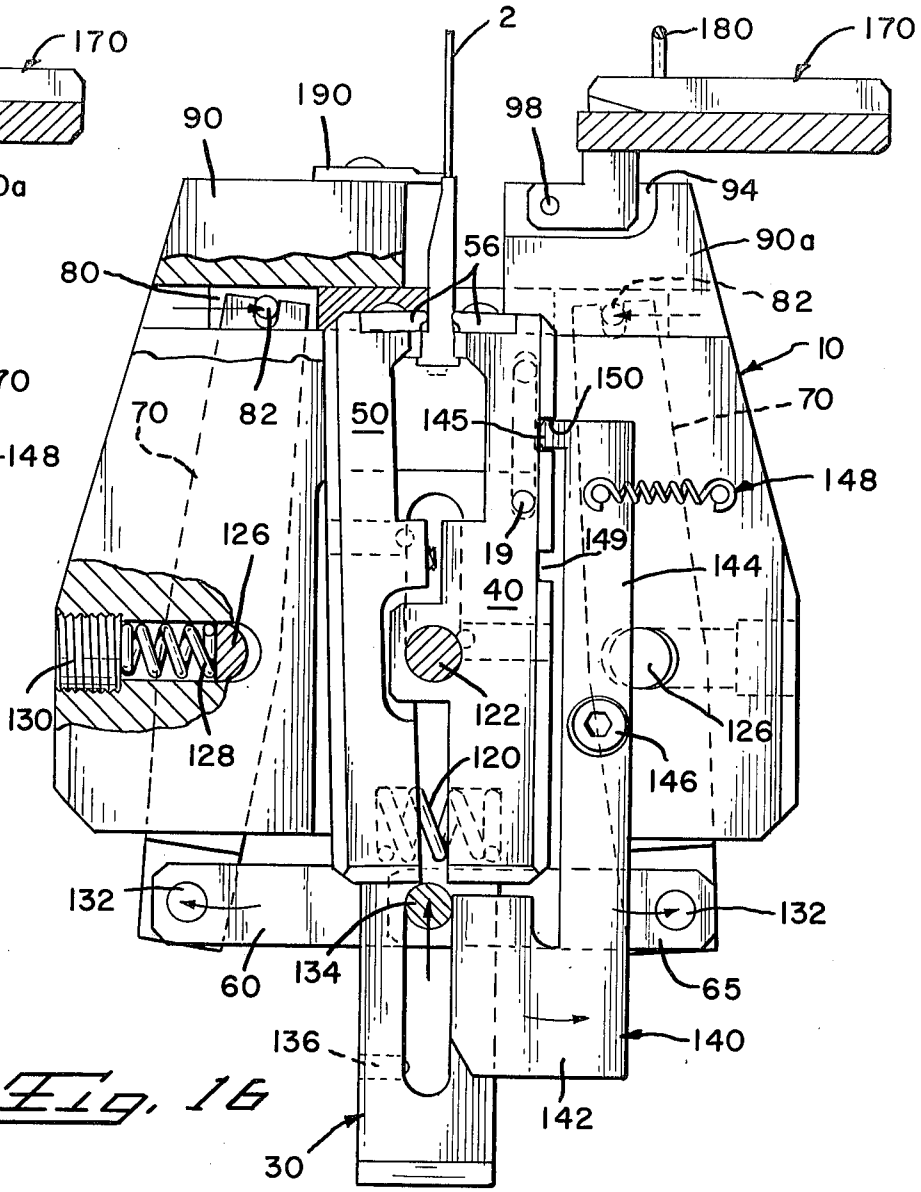
FIG. 16 is a side elevation with parts broken away showing the position after insertion.
Figure 15:
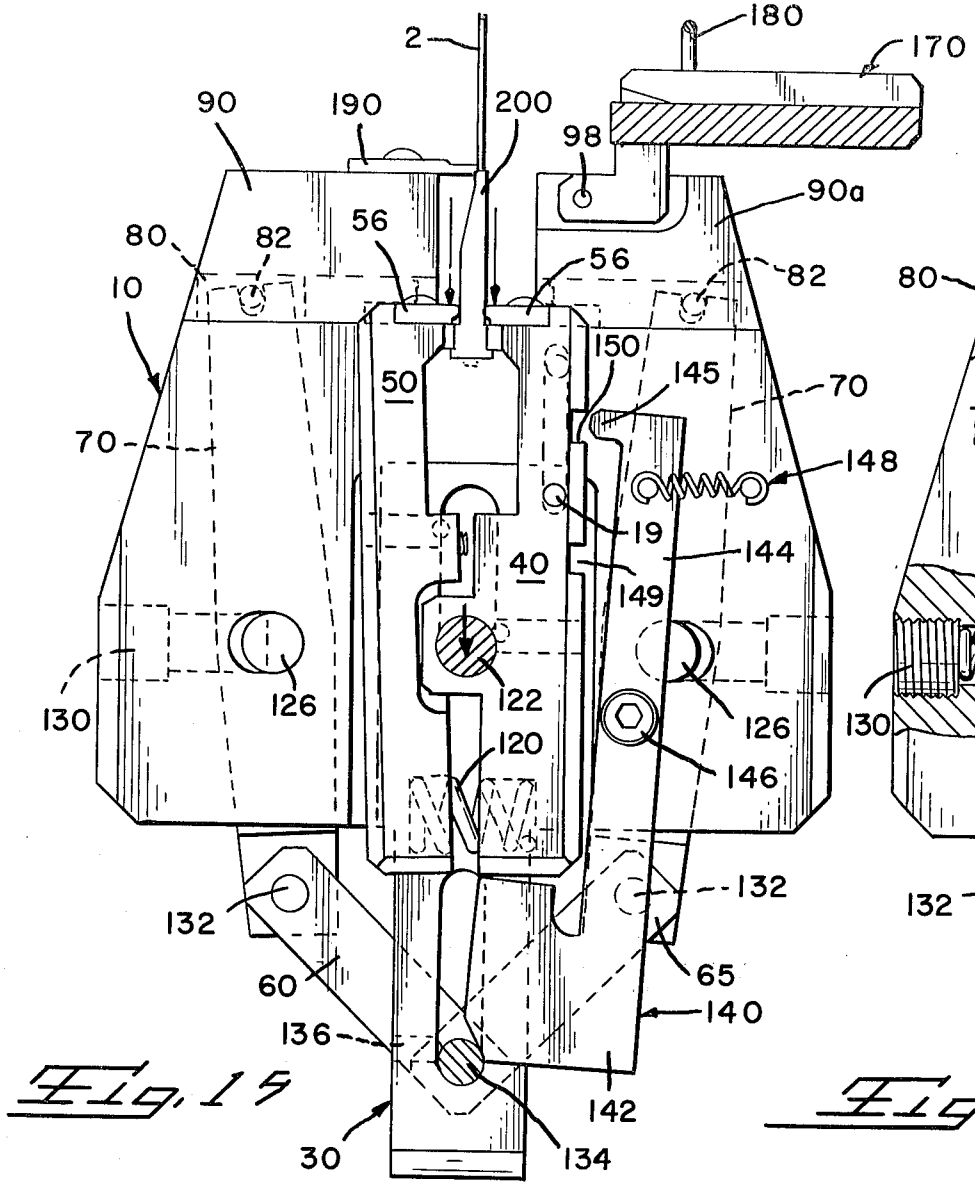
FIG. 15 is a side elevation with parts broken away showing the position after wiping.

Referring now to FIGS. 14, 15, and 16, the wiping and termination operation are shown. FIG. 14 shows the comb assembly 170 moved to its rest position and the conductors 4 moved into the connector. Note that shaft 126 is located forward in oval passage 17. In FIG. 15, the shaft 122 has been moved downward causing wipers 56 to progress down the surfaces 202 and 204 of the connector 200. The conductors are moved before the wipers 56 and are pressed into their respective grooves 208 in the connector 200. Spring 120, which in the preferred embodiment has a load range of 40 to 50 lbs. assures constant contact of the wipers throughout the surfaces changes of the connector. It should be realized that the desired force will be determined by the needs of the conductor-connector combination. In the general case, the spring force may be found by the formula:

$$\text{Spring load} = (a/b)\,(F)$$

where a = distance between the spring seat 42 or 52 and the shaft 122.

b = the distance between the shaft 122 and the wiper blade 56.

F = the desired force as determined for the individual combination.

If the connector has parallel surfaces throughout, spring 120 may be eliminated, however, it is believed that spring 120 is beneficial in either case. As an alternative to spring loading each of the wiper arms 40 and 50 may be fabricated to use a pin 19 and groove 151 which are tailored to the connector surfaces. Ball detent 124 will secure shaft 122 in the full down position. Note also that notch 150 is now located opposite finger 145.

Figure 17:
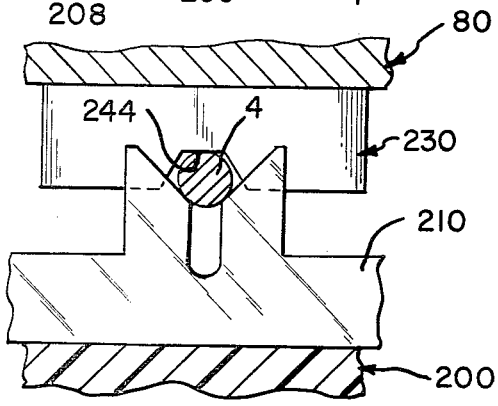
FIG. 17 is a fragmentary showing a single conductor prior to insertion.
Figure 17A:
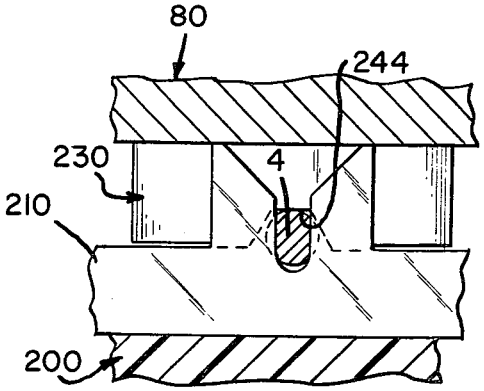
FIG. 17A is a fragmentary showing a single conductor after insertion.

FIG. 16 illustrates the termination operation. As the shaft 134 is moved upward, follower 142 will be moved outward, shaft 144 pivots about mount 146 and finger 145 engages notch 150 to lock the wiping means in a downward position. The upward motion of shaft 134 drives bar links 60 and 65 up and out to a final horizontal position. Rocker arms 70 are driven outward at flange 71 which causes the rocker arms to pivot about shaft 126 and drive groove 74 and tool carrier 80 inward. Rocker arms 70 moves about shaft 126 until the tooling meets the resistance of the conductors positioned against the terminal slots, see FIG. 17 which illustrate this relationship for a single conductor. Referring again to FIG. 16, once the tooling encounters sufficient resistance, additional upward movement of shaft 134 causes rocker arm 70 to modify its pivot point from shaft 126 to pin 82 in groove 74. This shift results from the horizontal travel of shaft 126 encountering the preload of springs 128 balanced against the resistance of the conductors in the slots. Thus, the shaft 126 will no longer be stationary but will, with the continued upward movement of shaft 134, move outward and cause compression of spring 128. As spring 128 is compressed, the tool carrier 80 is moved inward to cause termination of the conductors. The terminal receiving passage of terminating die is cut to a depth which will cause the terminals 210 or 212 to bottom against the tooling face when the conductors have been inserted to the desired depth. This depth control is provided to insure good termination without conductor or terminal damage due to over insertion. At this point the tooling is bottomed on the terminals and additional upward movement causes full compression of spring 128. The terminated condition for a single conductor is illustrated in FIG. 17A. In this manner spring 128 functions as a termination overstress device and therefore, should have a required maximum compressive force only slightly greater than the force required to achieve termination. When shaft 134 reaches maximum upward movement bar links 60 and 65 are horizontal. For the preferred embodiment it has been found that a spring 128 rated at 340 lb./in. enables tooling 80 to be moved 0.015 beyond initial resist which is the termination depth required for the connector 200. In the general case the spring force may be found by the formula:

$$\text{Spring Force} = (X/Y)(F)$$

where:

x = distance between shaft 132 and shaft 128.

y = distance between shaft 132 and pin 82.

F = the desired force as determined for the individual combination.

It should be noted that straight mechanical links could be used to achieve the desired termination, however, it is believed that the use of spring override prevents connector damage and assures proper depth of conductor insertion.

Figure 18:
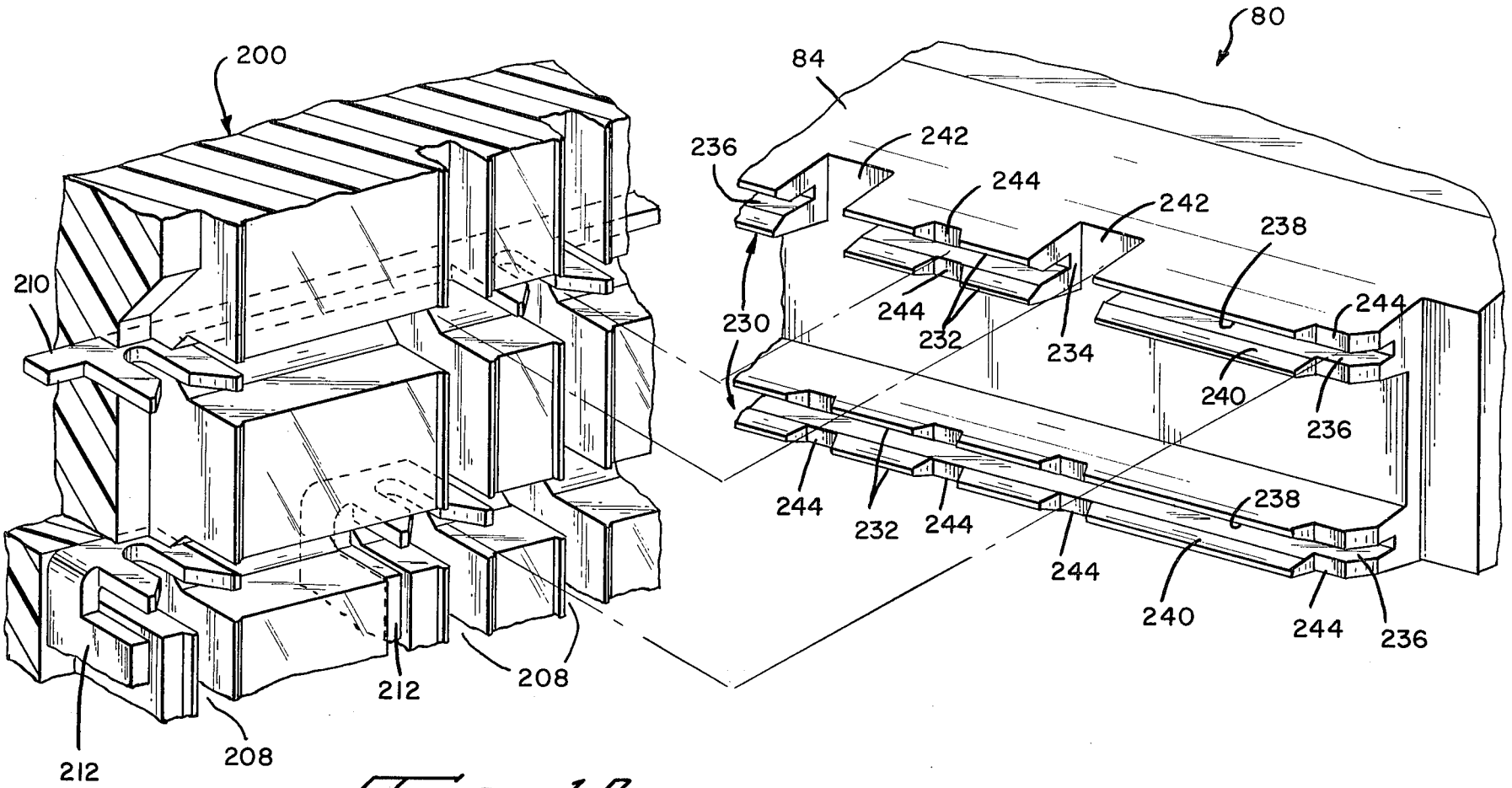
FIG. 18 is a fragmentary perspective showing the relationship of the tooling to the connector body.

FIG. 18 is a fragmentary perspective breakaway of the connector termination areas 210 and 212 and face 84 of tool carrier 80. Face 84 has parallel termination dies 230, each of which is comprised of paired parallel blades 232 and rear wall 234. Parallel blades 232 define a terminal receiving passage 236 for terminals 210 and 212 of the connector 200. The paired parallel blades 232 have complementary tapers 238 and 240 which provides a lead-in to assure terminal alignment and prevent damage thereto. The dies 230 are notch according to the predetermined termination requirement of the connector. Thus notches 242 are cut to a depth beyond wall 234 to permit a conductor to enter undisturbed. Notches 244 are termination notches and are cut to a depth perpendicular to the end of complementary tapers 238 and 240. This permits the die 230 to locate on the terminal before contact is made with the conductor, see FIG. 17, and to capture the conductor between the terminal and the die before termination force is applied. As continued force is applied parallel notches 244 will exert termination force to the conductor on either of the terminals and move the conductor into an interference fit with the terminals 210 or 212. At this point the conductors have been terminated and a reversal of shafts position will free the connector for removal.

Figure 19:
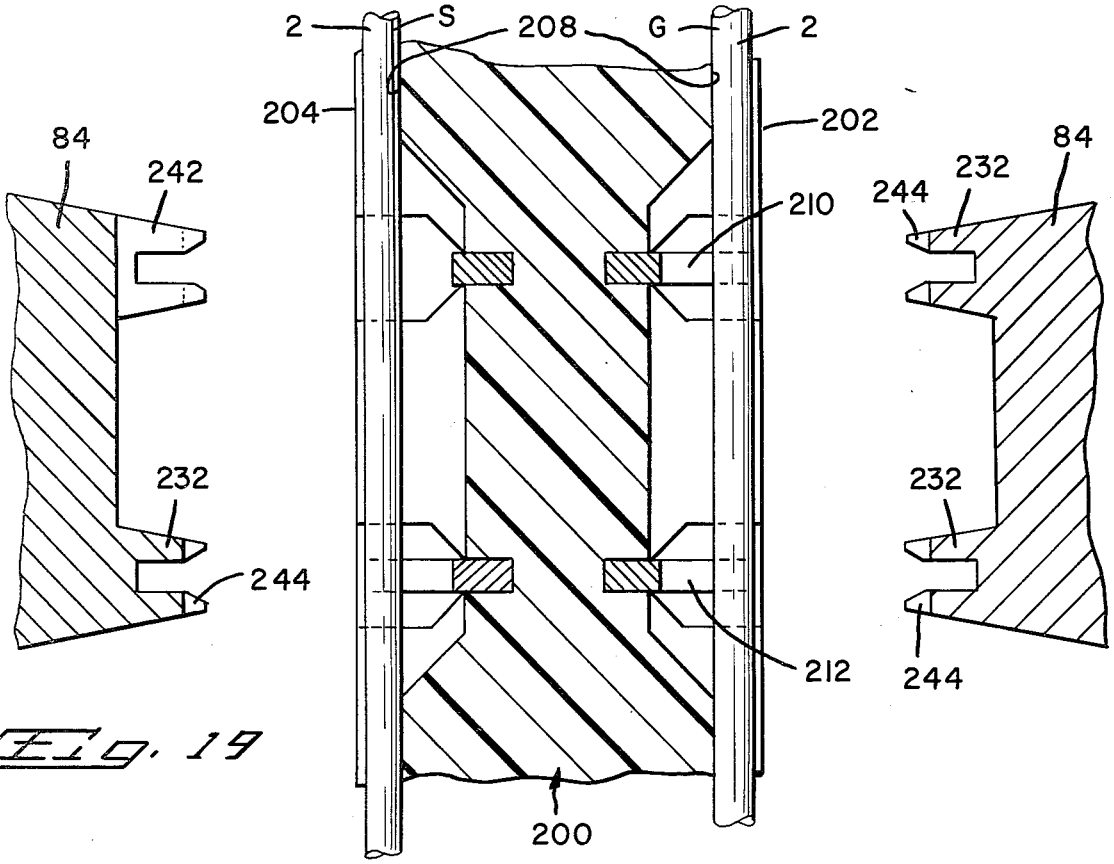
FIGS. 19 and 20 are enlarged fragmentary cross-sections showing conductor termination.
Figure 20:
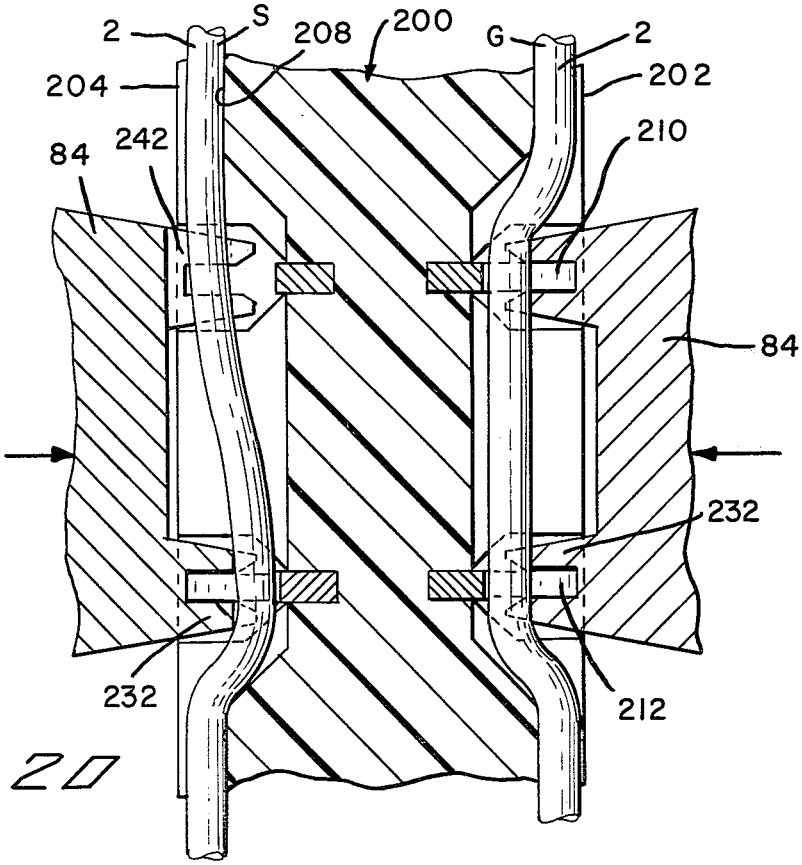

FIGS. 19 and 20 further illustrate the selective termination. Referring to FIG. 19, conductor 2 is shown wiped into connector 200. Conductor S is a signal conductor to be terminated to a signal terminal 212. Conductor G is a ground conductor for termination in ground terminal 210 and a signal terminal 212. The dies 232 therefore have three terminating positions 244 and a conductor by-pass notch 242. As shown in FIG. 20, the tooling will terminate conductor S to terminal 212 only but will terminate conductor G to both terminals 210 and 212.

The disclosed embodiment is to be considered in all respects as illustrative and not restrictive of the scope of the invention.

What is claimed is:

1. An apparatus for inserting conductors in a two sided connector comprising:

a housing having a connector receiving recess at one end thereof, said connector receiving recess being open on the top and at least one side, tool receiving cavities communicating with and on opposite sides of said connector receiving recess, rocker arm receiving cavities communicating with said tool receiving cavities, rocker shaft bores through said housing perpendicular to and communicating with said rocker arm cavities, first and second elongate passages aligned with and below said connector receiving recess and a hollow aligned with said rocker arm receiving cavities and intersecting said second elongate passage, conductor wiping means disposed on either side of said connector receiving recess and movably mounted on a first shaft extending through said first elongate passage for movement of said wiping means in a generally parallel relationship to said connector receiving cavity, conductor insertion tools slidably received in said tool receiving cavities, said tools having a conductor insertion means at one end thereof and a connecting means at the other end thereof, rocker arms located in said rocker arm cavities and pivotably mounted on rocker shafts located in said rocker shaft bores, said rocker arms having a union means at one end thereof and dimensioned at the other end thereof to cooperate with said conductor insertion tool connecting means, bar links dimensioned at one end to be received in said hollow and pivotably mounted on a common second shaft located in said second elongate passage, each of said bar links dimensioned at the other end thereof for pivotal union with said union means of a respective rocker arm, whereby said connector is located in said connector receiving cavity, conductors are presented to said connector, said first shaft is moved from a first position to a second position within said first elongate cavity to wipe said conductors along said connector, said second shaft is then moved from a first position to a second position within said second elongate cavity to slide said connector insertion tools into said connector receiving cavity and insert said conductors in said connector.

2. The apparatus of claim 1 further comprising:

conductor combing means mounted adjacent to and above said connector receiving cavity, said conductor combing means being movable from a first position perpendicular to said connector receiving recess to a second position in line with said connector receiving recess.

3. The apparatus of claim 1 or 2 wherein:

said conductor wiping means comprises two pairs of mated wiper arms and two wiper blades, said pairs of mated wiper arms being disposed on opposite sides of said conductor receiving cavity and adapted for mounting on said first shaft, each of said wiper blades being disposed parallel to and on opposite sides of said connector receiving cavity and affixed to respective sets of said wiper arms.

4. An apparatus for inserting conductors in a two sided connector comprising:

a housing having a connector receiving recess at one end thereof, said connector receiving recess being open on the top and at least one side and having connector register means and biasing means therein, tool receiving cavities on opposite sides of and communicating with said connector receiving recess, rocker arm receiving cavities communicating with said tool receiving cavities, oval rocker shaft bores through said housing perpendicular to and communicating with said rocker arm cavities, spring seats perpendicular to said rocker shaft bores and threaded at the end remote from said bores for receiving a set screw, first and second elongate passages aligned with and below said connector and receiving recess and a hollow aligned with said rocker arm receiving cavities and intersecting said second elongate passage, conductor wiping means disposed on either side of said connector receiving recess and moveably mounted on a first shaft extending through said first elongate passage for movement of said wiping means in a generally parallel relationship to said connector receiving cavity, conductor insertion tools slidably received in said tool receiving cavities, said tools having a conductor insertion means at one end thereof and a connecting means at one end thereof, rocker arms located in said rocker arm cavities and pivotably mounted on rocker shafts located in said rocker shaft bores, said rocker arms having a union means at one end thereof and dimensioned at the other end thereof to cooperate with said conductor insertion tool connecting means, spring means mounted in said spring receiving bores, said spring resting against said rocker shafts and preloaded by way of a set screw located in threads of said bore, bar links dimensioned at one end to be received in said hollow and pivotably mounted on a common second shaft located in said second elongate passage, each of said bar links dimensioned at the other end thereof for pivotal union with said union means of a respective rocker arm, whereby said connector is located in said connector receiving cavity, conductors are presented to said connector, said first shaft is moved from a first position to a second position within said first elongate cavity to wipe said conductors along said connector, said second shaft is then moved from a first position to a second position within said second elongate cavity to slide said conductor insertion tools into said connector receiving cavity and insert said conductors in said connector.

5. The apparatus of claim 4 further comprising:

conductor combing means mounted adjacent to and above said connector receiving cavity, said conductor combing means being movable from a first position perpendicular to said connector receiving recess to a second position in line with said connector receiving recess.

6. The apparatus of claim 4 or 5 wherein:

said conductor wiping means comprises two pairs of mated wiper arms and two wiper blades, said pairs of mated wiper arms being disposed on opposite sides of said conductor receiving cavity and adapted for mounting on said first shaft, each of said wiper blades being disposed parallel to and on opposite sides of said connector receiving cavity and affixed to respective sets of said wiper arms.

* * * * *

UNITED STATES PATENT OFFICE

CERTIFICATE OF CORRECTION

Patent No. 4,275,495 Dated June 30, 1981

Inventor(s) Andrew G. Boutcher, Jr. & Walter C. Shatto, Jr.

It is certified that error appears in the above-identified patent and that said Letters Patent are hereby corrected as shown below:

Column 10, Line 12, that portion reading "...connector and receiving recess..." should read "---connector receiving recess---".

Signed and Sealed this

*Twenty-ninth* Day of *September 1981*

[SEAL]

*Attest:*

GERALD J. MOSSINGHOFF

*Attesting Officer*

*Commissioner of Patents and Trademarks*